United States Patent [19]

Bohler et al.

[11] Patent Number: 4,656,922

[45] Date of Patent: Apr. 14, 1987

[54] MONITORING APPARATUS FOR MONITORING DELAYED FIRING CARTRIDGES IN AN EXTERNALLY DRIVEN FIRING WEAPON

[75] Inventors: Erwin Bohler, Zürich; Beat Iten, Niederhasli; Werner Bruderer, Zürich, all of Switzerland

[73] Assignee: Werkzeugmaschinenfabrik Oerlikon-Bührle AG, Zürich, Switzerland

[21] Appl. No.: 797,213

[22] Filed: Nov. 12, 1985

[30] Foreign Application Priority Data

Nov. 19, 1984 [CH] Switzerland ..... 5511/84

[51] Int. Cl.[4] ..... F41D 10/04; F41D 10/22; F41D 10/26

[52] U.S. Cl. ..... 89/33.17

[58] Field of Search ..... 89/9, 11, 12, 33.2, 89/33.25, 33.14, 33.16, 33.17

[56] References Cited

U.S. PATENT DOCUMENTS

| | | | |
|---|---|---|---|
| 3,153,368 | 10/1964 | Stanton et al. | 89/33.16 |
| 3,277,787 | 10/1966 | Brieger | 89/33.25 |
| 3,776,416 | 12/1973 | Ashley et al. | 89/12 |
| 4,253,376 | 3/1981 | Washburn et al. | 89/33.14 |
| 4,397,216 | 8/1983 | Tassie | 89/33.25 |
| 4,550,641 | 11/1985 | Bruderer et al. | 89/11 |

FOREIGN PATENT DOCUMENTS

| | | | |
|---|---|---|---|
| 0020095 | 12/1980 | European Pat. Off. | 89/33.14 |
| 6709126 | 1/1968 | Netherlands | 89/33.25 |
| 81/01328 | 5/1981 | PCT Int'l Appl. | 89/33.17 |

*Primary Examiner*—Stephen C. Bentley
*Assistant Examiner*—Stephen Johnson
*Attorney, Agent, or Firm*—Werner W. Kleeman

[57] ABSTRACT

In the case of delayed firing of a cartridge or a so-called hang-fire condition in an externally powered firing weapon there must be prevented that further cartridges are fed into the firing weapon. In a known safety or monitoring apparatus of this type a deflector must be pivoted such that the infed cartridges, instead of arriving at the firing weapon, arrive at an ejection channel. The change-over of this deflector requires high acceleration forces because a great mass must be pivoted through a large pivot angle in a short period of time. In accordance with the invention the deflector comprises two segment members which are displaceable in the direction of the cartridge axes, one of which segment members selectively protrudes into the travel path of the cartridges.

8 Claims, 5 Drawing Figures

FIG. 2
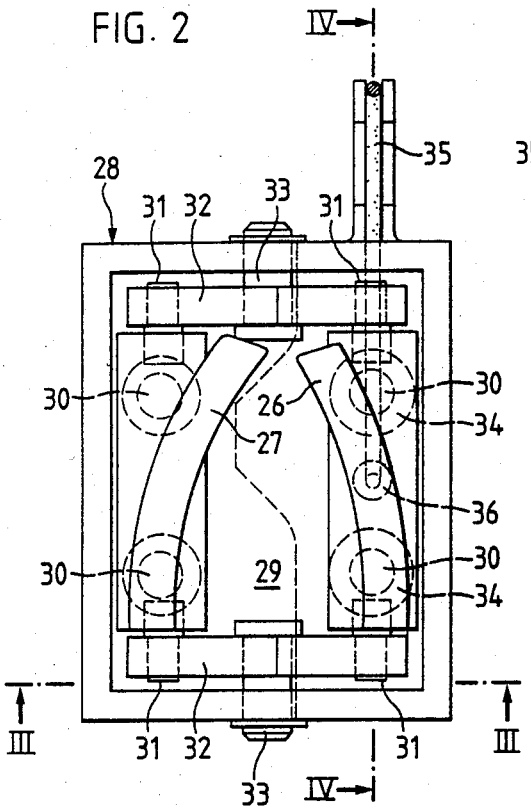
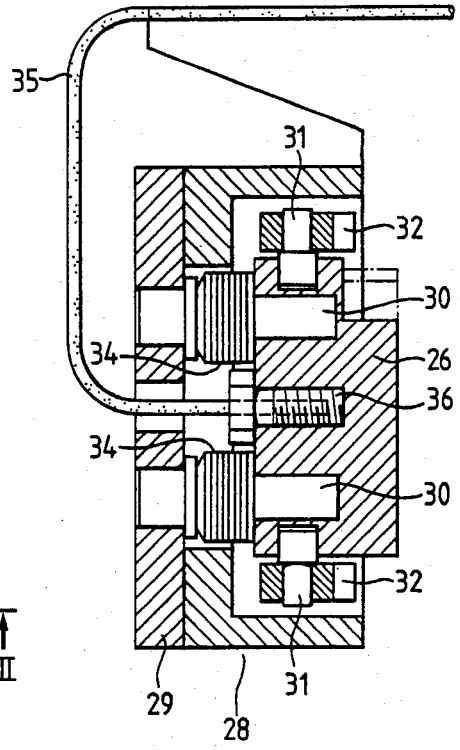
FIG. 4
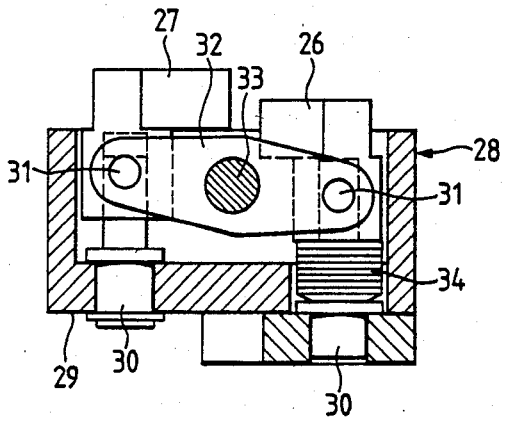
FIG. 3

MONITORING APPARATUS FOR MONITORING DELAYED FIRING CARTRIDGES IN AN EXTERNALLY DRIVEN FIRING WEAPON

CROSS-REFERENCE TO REFERENCE TO RELATED APPLICATION

This application is related to the commonly assigned copending U.S. patent application Ser. No. 06/797,416 filed Nov. 12, 1985, and entitled "Switch or Control cable arrangement and Method of Using the Same", the disclosure of which is incorporated herein by reference.

BACKGROUND OF THE INVENTION

The present invention relates to a new and improved construction of a safety or monitoring apparatus for monitoring delayed firing cartridges or a so-called hang-fire condition in an externally powered firing weapon.

In its more particular aspects the present invention relates to a new and improved construction of a safety or monitoring apparatus for monitoring delayed or late firing or cartridges in an externally powered firing weapon and containing an ammunition feed housing in which a deflector or deflecting means, i.e. a transfer means, is displaceably mounted. When a firing delay or a hang-fire condition occurs, the deflector or deflecting means deflects, i.e. transfers, the infed cartridges into an ejection channel of the ammunition feed housing and the cartridges are then received by and remain on an endless chain.

A safety or monitoring apparatus of the aforementioned type is known, for example, from European Patent Publication No. 0,111,240, which is cognate to U.S. Pat. No. 4,550,641 granted on Nov. 5, 1985. In such apparatus the cartridges are transported into a weapon housing by means of a star or finger wheel and are pushed therein into one or more weapon barrels by means of one or more breech mechanisms. After firing the cartridges, the empty cartridge cases are extracted from the weapon barrel and ejected. When a firing delay or hang-fire condition occurs, the cartridge is no longer withdrawn from the weapon barrel and no further cartridge should be infed. The cartridges infed by the star or finger wheel are consequently no longer fed to the weapon but are returned on an endless chain. For this purpose, a deflector is positionally changed-over when a firing delay or hang-fire condition occurs in order that the cartridges are no longer transported to the weapon but remain on the endless chain.

This known deflector or deflecting means has various disadvantages, some of which are enumerated as follows:

(i) In the short time available the deflector must be pivoted through a relatively large angle.

(ii) Such a deflector possesses a relatively great mass which must be pivoted within the short time available. The pivoting through the large angle as well as the pivoting of the great mass in the short time available requires high acceleration and deceleration forces and leads to high wear.

(iii) These deflectors do not allow direct subsequent firing of the deflected cartridges. These deflected cartridges are ejected into a separate container.

SUMMARY OF THE INVENTION

Therefore, with the foregoing in mind, it is a primary object of the present invention to provide a new and improved construction of a safety or monitoring apparatus for monitoring delayed firing cartridges in an externally powered firing weapon and which does not exhibit the aforementioned drawbacks and shortcomings of the prior art construction.

Another and more specific object of the present invention aims at the provision of a new and improved construction of a safety or monitoring apparatus for monitoring delayed firing cartridges in an externally powered firing weapon and which contains a deflector or deflecting means carrying out a relatively small stroke or displacement and possesses a relatively small mass and therefore requires small deflecting forces so that the wear is small and a reliable positional changeover of the deflector is guaranteed.

Now in order to implement these and still further objects of the invention, which will become more readily apparent as the description proceeds, the safety or monitoring apparatus of the present development is manifested by the features that the deflector or deflecting means contains two segments or segment members which are displaceable in the direction of the cartridge axes, i.e. in the lengthwise direction of the cartridge and one of which segments always selectively protrudes into the travel path of the cartridges.

Preferably, the two segments or segment members are linked to the ends of at least one balancing or rocker beam which is pivotably mounted in a housing in order to positively displace the two segments or segment members in opposite directions.

In a preferred embodiment of the inventive safety or monitoring apparatus at least one compression or pressure spring is provided which is supported at one of the two segments or segment members and at the housing and which tends to displace one segment or segment member into an operative position and the other one of the two segments or segment members into an inoperative position.

Preferably, an operating cable is fixed to one of the two segments or segment members for operating the two segments or segment members in order to displace the aforementioned one segment or segment member into its inoperative position against the force of the aforementioned compression or pressure spring.

In accordance with a further preferred embodiment of the inventive safety or monitoring apparatus, guide pins which project into bores or holes of the two segments or segments members are fixed or fastened in the aforementioned housing for guiding the two segments or segment members which are displaceable on these guide pins.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein:

FIG. 2 is an elevational view on an enlarged scale of only the safety or monitoring apparatus;

FIG. 3 is a section along the line III—III in FIG. 2;

FIG. 4 is a section along the line IV—IV in FIG. 2; and

DETAILED DESCRIPTION OF THE PREFERRED EMBODIMENTS

Figure 1:
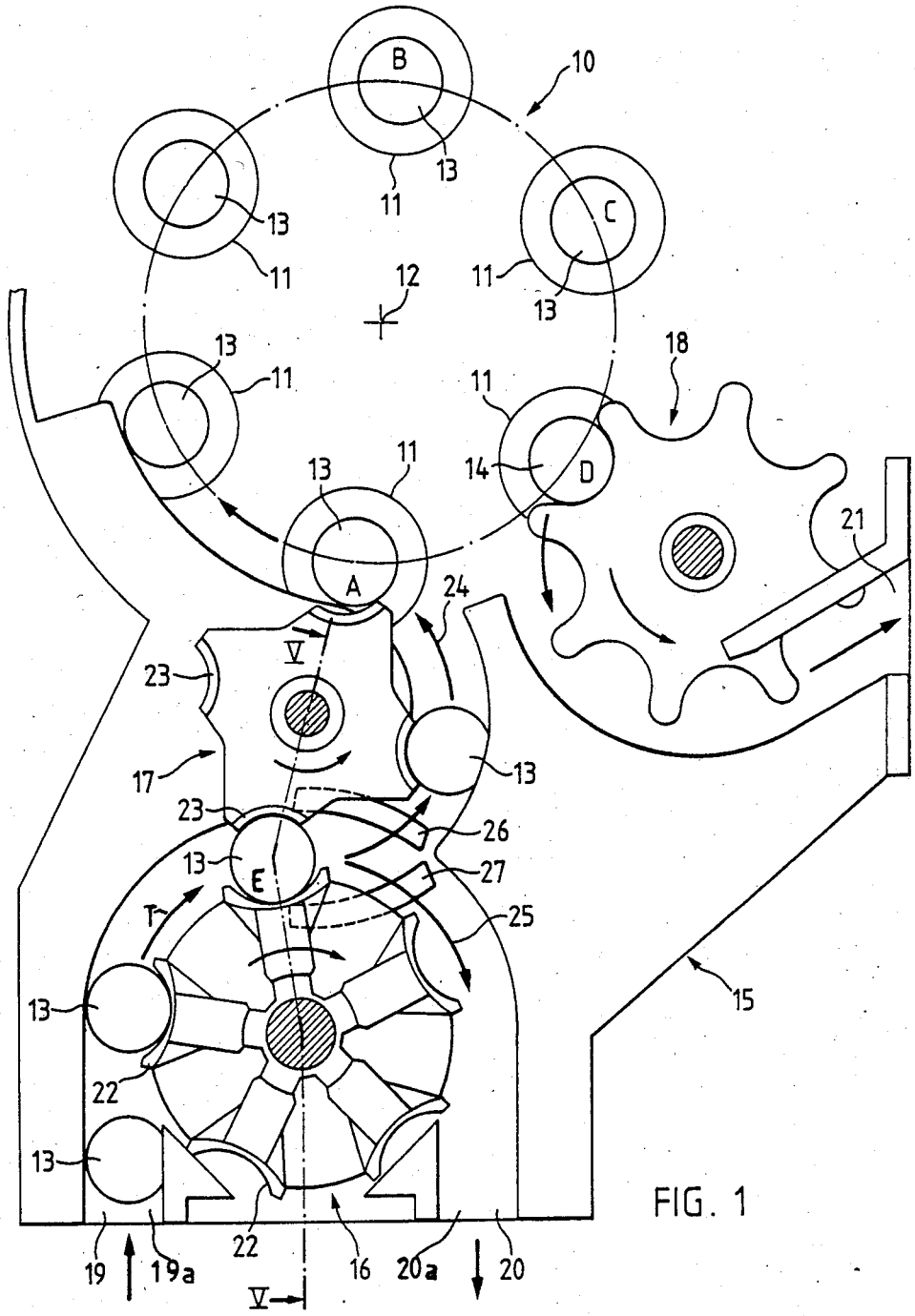
FIG. 1 shows a cross-section through an externally powered firing weapon and illustrates the ammunition feed using an exemplary embodiment of the safety or monitoring apparatus in accordance with the invention.

Describing now the drawings, it is to be understood that to simplify the showing thereof only enough of the structure of the safety or monitoring apparatus has been illustrated therein as is needed to enable one skilled in the art to readily understand the underlying principles and concepts of this invention. Turning now specifically to FIG. 1 of the drawings, an exemplary embodiment of the inventive safety or monitoring apparatus is illustrated therein in combination with an externally powered firing weapon 10, especially a Gatling firing weapon, of which only six weapon barrels 11 are visible. These six weapon barrels 11 are fixed to a not particularly shown rotor which is mounted for rotation about a firing weapon axis 12 in a manner which is known as such. At a point A cartridges 13 are fed to the breech mechanisms of the weapon barrels 11 in a manner further described hereinbelow. At a position B the cartridges 13 are fired in a manner which is likewise known as such. At a position C there is determined by means of a sensor element whether the cartridge was properly fired. At a position D empty cartridge cases 14 are ejected, as will also be described further hereinbelow.

The feed means for feeding ammunition to the firing weapon 10 possess an ammunition feed housing 15 which defines a predetermined travel path T for the cartridges 13 and in which three star or finger wheels 16, 17 and 18 are appropriately rotatably mounted. These three star or finger wheels 16, 17, 18 are driven by means of a here not particularly illustrated gear wheel drive. The first star or finger wheel, which is designated as an infeed star or finger wheel 16, possesses five-take up or receiving locations or pockets 22 for the cartridges 13. The second star or finger wheel, designated as a transfer star or finger wheel 17, possesses only four take-up or receiving locations or pockets 23 for the cartridges 13 to be fed to the firing weapon 10. The third star or finger wheel, designated as an ejection star or finger wheel 18, possesses eight effective or active take-up or receiving locations for the empty cartridge cases 14.

The above-mentioned ammunition feed housing 15 possesses three openings 19*a*, 20*a* and 21. One of these openings constitutes an infeed opening 19*a* which communicates with an infeed channel 19, and the ammunition, i.e. the cartridges 13 to be fired, are fed through this infeed opening 19*a* and the infeed channel 19. A further one of these openings constitutes an outfeed opening 20*a* of the ammunition feed housing 15 and communicates with an outfeed channel 20 through which in all cases unfired but still live cartridges are received by and remain on a not particularly shown endless chain or belt. On the other hand, the empty cartridge cases 14 of the fired cartridges 13 are ejected through the third or ejection opening 21 in the ammunition feed housing 15.

The cartridges 13 are infed through the infeed opening 19*a* and the infeed channel 19 in a manner which is known as such and by means of a here not particularly illustrated endless conveyor or any other known suitable conveying means. The cartridges 13 located in the infeed channel 19 are held or engaged by the take-up or receiving locations or pockets 22 of the first or infeed star or finger wheel 16 and are transported to a position E. At this position E each cartridge 13 is not only located in the take-up or receiving location or pocket 22 of the first or infeed star or finger wheel 16 but also already in the take-up or receiving location or pocket 23 of the second or transfer star or finger wheel 17. From this position E the cartridge 13 can be fed either to the position A of the firing weapon 10 by means of the second or transfer star or finger wheel 17 or returned back through the outfeed channel 20 to the outfeed opening 20*a* by means of the first or infeed star or finger wheel 16 as indicated by the two arrows 24 and 25.

As a deflector or deflecting means two segments or segment members 26 and 27 are provided in order to either feed the cartridges 13 in the direction of the arrow 24 to the firing weapon 10 or return the cartridges 13 in the direction of the arrow 25 back into an ammunition container or magazine. Each of these two segments or segment members 26 and 27 can be selectively displaced from an operative position into an inoperative position. If one segment or segment member, namely, for instance, the segment or segment member 27 is located in the operative position, then, the cartridges 13 arrive at the firing weapon 10. If the other segment or segment member, namely the segment or segment member 26 is located in its operative position, then the cartridges 13 travel through the outfeed channel 20 and are received by and remain on the endless chain or belt and subsequently can be returned to the ammunition container or magazine.

In accordance with FIGS. 2 to 4 the two segments or segment members 26 and 27 are displaceably arranged in a housing 28. Four guide pins 30 are fixed in a floor or base 29 of the housing 28 and protrude into related bores or holes of the two segments or segment members 26 and 27 in order to accurately guide these two segments or segment members 26 and 27 in the housing 28. At each end of the two segments or segment members 26 and 27 there are fastened related pins 31 which project into related bores or holes of two balancing or rocker beams 32. The two balancing or rocker beams 32 serving as coupling means for the segment members 26 and 27 are mounted for pivoting about related pins 33 in the housing 28 and serve the purpose of lowering one of the two segments or segment members when the other one of the two segments or segment members 26 and 27 is raised i.e. one of the two segments is moved towards the cartridge base in the direction of the lengthwise cartridge axis, whereas the other segment is moved away from the cartridge base in the direction of the lengthwise cartridge axis.

Two sets or stacks 34 of cup or Belleville springs or equivalent structure tend to push or urge the segment or segment member 26 from its lowermost position shown in FIG. 3 into its uppermost position. An operating cable 35 is secured to the segment or segment member 26 by means of a bolt 36 and is capable of pulling or displacing this segment or segment member 26 against the force of the sets or stacks 34 of the cup springs or the like into the illustrated lowermost position. In the starting position in accordance with FIGS. 3 and 4, the operating cable 35 is tensioned and the sets or stacks 34 cup springs are compressed. The segment or segment member 26 is located in its lowermost or inoperative position and the segment or segment member 27 is located in its uppermost or operative position. Consequently, the cartridges 13 arrive at the firing weapon 10 in this starting position of the segments or segment members 26 and 27.

Figure 5:
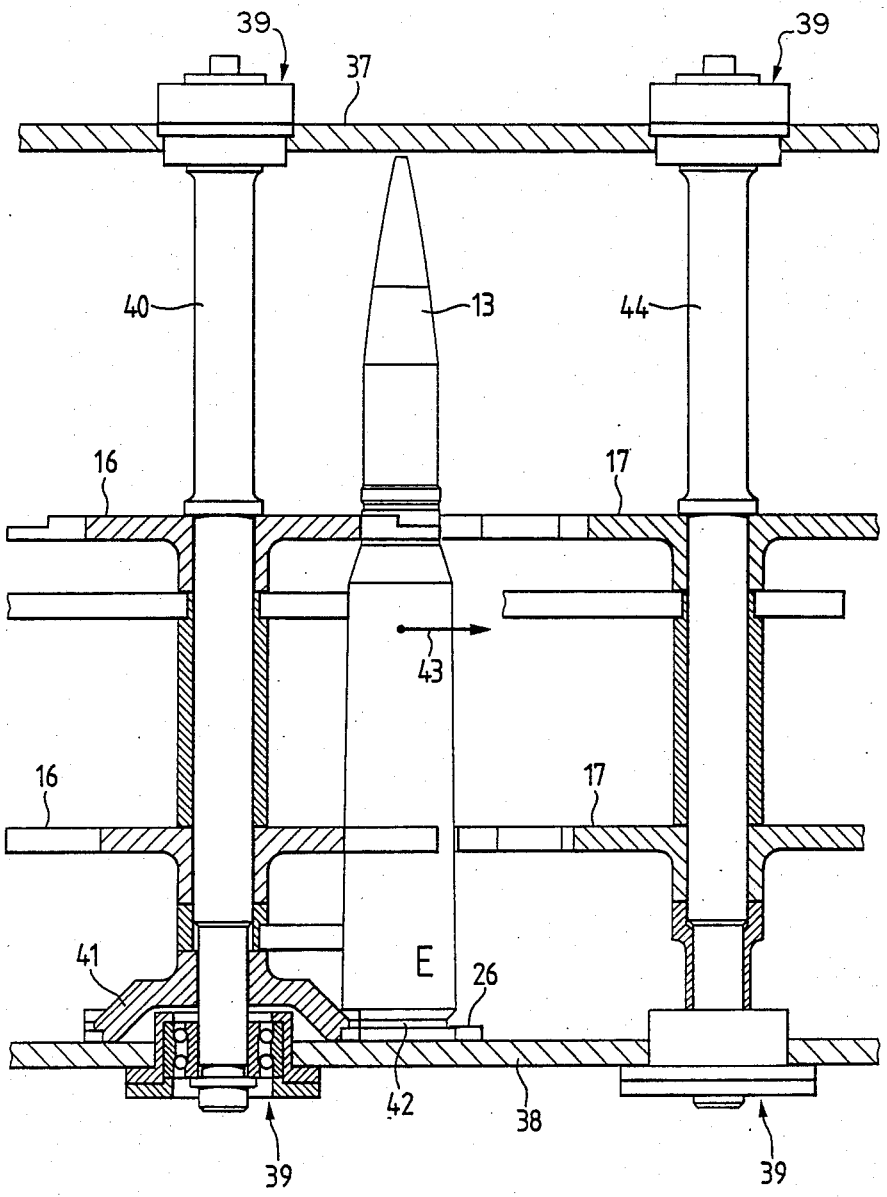
FIG. 5 is a section along the line V—V in FIG. 1.

In accordance with FIG. 5 two first or infeed star or finger wheels 16 are fixed to a shaft 40 and two second or transfer star or finger wheels 17 are fixed to a shaft 44. These two shafts 40 and 44 are located in the ammunition feed housing 15 shown in FIG. 1 between two walls 37 and 38 and are journalled in these walls 37 and 38 by means of four related ball bearings 39. The cartridge 13 which, according to FIG. 1, is located at the position E, is held by the four star or finger wheels 16 and 17 and by one of the two segments or segment members 26 and 27 and, according to FIG. 5, is additionally held by a disk or plate 41 which engages a withdrawal groove 42 provided in the cartridge 13. This is necessary so that the cartridge 13 does not topple or tilt in the direction of the arrow 43 as soon as such cartridge is held by only one of the two star or finger wheels 16 or 17 when transported out of the position E in the direction of one of the arrows 24 and 25.

The mode of operation of the safety or monitoring apparatus described hereinbefore is as follows:

When starting a continuous or series firing operation, the cartridges 13 are transported by means of a not particularly shown conveying apparatus from the ammunition container or magazine through the infeed opening 19*a* and the infeed channel 19, see FIG. 1, and are placed into the position E by the first or infeed star or finger wheel 16. Due to the fact that the two segments or segment members 26 and 27 are in the starting position shown in FIG. 3, the cartridges 13 are subsequently brought to the position A, see FIG. 1, by means of the second or transfer star or finger wheel 17, see arrow 24. From this position A the cartridges 13 are inserted into the weapon barrel 11 by a here not particularly illustrated breech mechanism and thereafter the breech mechanism is locked. The cartridge 13 is fired at the position B, see FIG. 1. The empty cartridge case 14 is withdrawn from the weapon barrel 11 at the position C, see FIG. 1, and arrives at the position D, see also FIG. 1, at which it is engaged by the third or ejection star or finger wheel 18 and ejected through the ejection opening 21.

When a firing delay occurs, i.e. when the cartridge 13 does not react in time to the piercing of its detonator, or in the case of a hang-fire condition, the cartridge case 14 cannot be withdrawn from the weapon barrel 11 at the position C as intended. The presence of a delayed firing cartridge in the position C is detected by means of a suitable sensor element which is known as such and therefore not particularly here illustrated. The two segments or segment members 26 and 27 are then displaced from their starting position shown in FIG. 3 by means of the operating cable 35 and the action of the spring sets or stacks 34, see FIG. 2. Consequently, one of the two segments or segment members 26 and 27, namely the segment or segment member 26 is moved into its operative position and the other segment or segment member, namely the segment or segment member 27 is moved into its inoperative position. Hence the cartridges 13 no longer move from their position E to the position A of the firing weapon 10 but are transported in accordance with the arrow 25 through the first or infeed star or finger wheel 16 to the outfeed opening 20*a* and the outfeed channel 20.

Irrespective of whether the cartridges 13 are moved in accordance with the arrow 24 to the position A or in accordance with the arrow 25 to the outfeed channel 20, such cartridges are held, as shown in FIG. 5, by the disk 41 which projects into the cartridge withdrawal groove 42. Therefore, any toppling or tilting movement of the cartridge 13 in the direction of the arrow 43, see FIG. 5, can be reliably prevented.

While there are shown and described present preferred embodiments of the invention, it is to be distinctly understood that the invention is not limited thereto, but may be otherwise variously embodied and practiced within the scope of the following claims.

Accordingly, what we claim is:

1. A monitoring apparatus for monitoring delayed firing cartridges in an externally powered firing weapon, each of the cartridges having a lengthwise cartridge axis, comprising:

an ammunition feed housing for receiving cartridges and feeding such cartridges along a predetermined travel path;

said ammunition feed housing possessing an outfeed channel;

deflecting means for the cartridges displaceably supported in said ammunition feed housing;

said deflecting means serving for deflecting said cartridges received by said ammunition feed housing, at and only at the occurrence of a firing delay, to said outfeed channel for enabling reception of the deflected cartridges by an endless chain;

said deflecting means containing two segment members;

said deflecting means comprising means for selectively deflecting said two segment members in the direction of the lengthwise cartridge axis during operation of the firing weapon; and a selectively deflected one of said two segment members protruding into said predetermined travel path.

2. The monitoring apparatus as defined in claim 1, wherein:

said ammunition feed housing further contains an infeed channel;

each one of said two segment members being capable of assuming an operative position;

one segment member of said two segment members, in said operative position thereof, protruding into said outfeed channel; and the other segment member of said two segment members, in said operative position thereof, protruding into said infeed channel.

3. The monitoring apparatus as defined in claim 1, further including:

a rotatable disc arranged in the region of said two segment members; and said rotatable disc engaging each said cartridge received in said ammunition housing at a cartridge withdrawal groove in order to prevent said cartridge from tilting.

4. A monitoring apparatus for monitoring delayed firing cartridges in an externally powered firing weapon, each of the cartridges having a lengthwise cartridge axis, comprising:

an ammunition feed housing receiving cartridges and feeding such cartridges along a predetermined travel path;

said ammunition feed housing possessing an outfeed channel;

deflecting means for the cartridges displaceably supported in said ammunition feed housing;

said deflecting means deflecting said cartridges received by said ammunition feed housing, at the occurrence of a firing delay, to said outfeed channel for enabling reception of the deflected cartridges by an endless chain;

said deflecting means containing two segment members;

means for deflecting said segment members in the direction of the lengthwise cartridge axis;

one of said two segment members selectively protruding into said predetermined travel path;

said deflecting means comprising at least one rocker beam having two ends;

said two segment members being linked to related ones of said two ends of said at least one rocker beam;

a housing; and said at least one rocker beam being pivotably mounted in said housing in order to positively displace said two segment members in opposite directions.

5. The monitoring apparatus as defined in claim 4, wherein:

said deflecting means further comprise at least one compression spring;

said at least one compression spring being supported at one segment member of said two segment members and at said housing;

each one of said two segment members being capable of assuming an operative position and an inoperative position; and said at least one compression spring urging said one segment member into said operative position and the other one of said two segment members into said inoperative position.

6. The monitoring apparatus as defined in claim 5, further including:

an operating cable for operating said two segment members;

said operating cable being fixed to one segment member of said two segment members; and said operating cable displacing said one segment member into said inoperative position thereof against the force of said at least one compression spring.

7. The monitoring apparatus as defined in claim 6, further including:

a predetermined number of guide pins fixed in said housing;

said two segment members being provided with bores;

said guide pins protruding into related ones of said bores provided in said two segment members; and said two segment members being displaceable on said guide pins.

8. A monitoring apparatus for cartridges in an externally actuated firing weapon and with each cartridge having a respective lengthwise axis, comprising:

an ammunition feed housing defining a predetermined travel path for the cartridges;

said predetermined travel path comprising a cartridge infeed channel for receiving the cartridges, a cartridge transfer means for transferring the received cartridges to the firing weapon for firing and a cartridge outfeed channel for outfeeding the received cartridges;

deflecting means arranged in said ammunition feed housing;

said deflecting means comprising a first segment member translatable in a direction extending substantially parallel to said lengthwise cartridge axis for selectively enabling and preventing transfer of the received cartridges from said cartridge infeed channel to said cartridge transfer means;

said deflecting means comprising a second segment member translatable in said direction extending substantially parallel to said lengthwise cartridge axis for selectively preventing and enabling outfeed of the received cartridges from said cartridge infeed channel to said cartridge outfeed channel; and coupling means for constraining said first segment member and said second segment member to translate in alternation such that said first segment member enables transfer when said second segment member prevents outfeed and said first segment member prevents transfer when said second segment member enables outfeed.

* * * * *